United States Patent [19]

James et al.

[11] 4,016,831

[45] Apr. 12, 1977

[54] APPARATUS FOR APPLYING A FOAM BACKING TO FABRIC

[75] Inventors: Forrest T. James, Burlington; Stephen L. Guy, Greensboro, both of N.C.

[73] Assignee: Burlington Industries, Inc., Greensboro, N.C.

[22] Filed: Apr. 7, 1975

[21] Appl. No.: 565,704

[52] U.S. Cl. ..... 118/415

[51] Int. Cl.[2] ..... B05C 3/18

[58] Field of Search ..... 118/407, 413, 414, 415; 425/4 C, 141; 156/78; 427/355, 356, 373

[56] References Cited

UNITED STATES PATENTS

| | | | |
|---|---|---|---|
| 2,632,422 | 3/1953 | Elkins | 118/415 |
| 2,874,407 | 2/1959 | Chabot et al. | 118/415 X |
| 3,235,400 | 2/1966 | Voelker | 118/415 X |
| 3,279,424 | 10/1966 | Brown, Jr. et al. | 118/414 X |

*Primary Examiner*—John P. McIntosh
*Attorney, Agent, or Firm*—Cushman, Darby & Cushman

[57] ABSTRACT

A method and apparatus for the application of foam backing to a fabric web without the introduction of hose and streak marks on the fabric breaking. A foam pillow is established on a fabric web by confining it on two sides thereof with guide plates, and on the front thereof with a doctor blade or stationary roller. The web is started moving, whereby the pillow is caused to generally roll or rotate about a generally horizontal axis. A gap of predetermined size between the bottom of the doctor blade or roller and the top surface of the web allows only a portion of the foam from the pillow to adhere to the web and be carried along therewith, the foam providing a backing for the fabric. The volume of foam in the pillow is maintained by the introduction of new foam into the volume of the pillow at at least two points on either side of the pillow, to flow generally along the axis of rotation of the pillow.

6 Claims, 4 Drawing Figures

APPARATUS FOR APPLYING A FOAM BACKING TO FABRIC

BACKGROUND AND SUMMARY OF THE INVENTION

The invention relates in general to a method and apparatus for coating fabric, such as drapery fabric or the like, with foam to form a backed fabric. In particular, it relates to the method and apparatus for foam coating fabric without any visible "streak" or "hose" marks on the fabric backing.

According to the method of fabric foam-backing most commonly used at present, fluid-foam is formed in a reservoir (otherwise known as a pillow, puddle, or bank) on top of a web of fabric to be backed. The front edge portion of the reservoir is formed by a doctor blade, stationary roller, or the like, which blade or roller has the bottom surface thereof spaced a predetermined distance from the fabric web. As the fabric moves past the foam pillow and doctor blade, a predetermined amount of foam adheres thereto, forming the backing thereof, and additionally causes the foam pillow to "rotate" or "roll" generally about a horizontal axis. The volume of foam in the pillow is replenished by traversing a hose along the top surface thereof, which hose delivers fluid foam to the pillow. Since the pillow is rotating, however, the foam most recently deposited by the hose rotates directly into contact with the fabric web. Since the "new" foam has a slightly different density than the "old" foam volume in the reservoir, streak or hose marks occur on the foam backing, leading to an unsightly appearance. Typical prior art devices for practicing such a method (as applied to carpets rather than fabrics, however) are shown in "Vinyl: a Superior Foam for Carpet Backing", by DeVito and Simoneau, Modern Textiles, Vol. 52, April 1971, pp. 24, 26, 28, and 32, and "Vinyl Finds Huge New Foam Market (Maybe 500 Million Lb. by '75)", by Hall, Modern Plastics, February 1972, pp. 51–53.

It has been suggested that air bubbles in the foam pillow may be prevented by depositing the foam to be added directly into the foam pillow, rather than just on top of it (see "Acrylic Foam Backing: Here's How To", by Abbenheim, Textile Manufacturer, January-February 1972, pp. 43–44). A practical way of accomplishing this without introducing "hose" marks has not — it is believed — been suggested, however. If the hose is merely placed directly into the top of the pillow, then the rotation of the pillow therepast will result in the introduction of hose marks which it is an object of the present invention to avoid. Also, problems with side-to-side variations of the foam may result. If the hose is placed into the foam pillow from the top and is reciprocated, then hose marks still remain, and the possibilities of introducing air into the pillow by a "furrow" that will be formed on the rolling surface of the pillow will be greatly enhanced.

According to the teachings of the present invention, a method and apparatus for foam backing of fabric are provided that solve the problem of streak marks being formed on the foam backing by the entrainment of air in the foam pillow, and eliminates hose marks being formed thereon. According to the method of the present invention, fluid foam is introduced into a foam pillow to maintain the volume thereof by directing foam to flow substantially along the axis of rotation of the foam pillow on either side thereof. By "generally along the axis of rotation of the foam pillow" is meant that the form is introduced within the volume of the pillow (i.e. the point of introduction is completely surrounded by the foam of the pillow) and is directed so that it flows initially in a substantially horizontal plane that is substantially parallel to the plane of the fabric web. In this way the introduced foam is completely mixed with the foam already in the pillow, and there are no readily visible lines of demarcation between "old foam" and "new foam" areas. No air is entrained since the new foam is introduced directly into the pillow, and there are no hose marks because there is nothing to obstruct and deform the rotating surface of the pillow as it moves into contact with the fabric web to be deposited thereon.

According to the apparatus of the present invention, two hoses are provided having end portions thereof extending into the foam pillow substantially along the axis of rotation thereof, one hose being provided through a guide plate or side deckle on either side of the foam pillow. Complicated traversing devices of the prior art are eliminated. Only the web and foam need to move — no other moving parts need be provided.

It is the primary object of the present invention to provide a method and apparatus for foam backing of fabric, such as drapery fabric and the like, that does not leave streak and hose marks in the foam backing. This and other objects of the invention will become clear from an inspection of the detailed description of the invention, and from the appended claims.

DETAILED DESCRIPTION OF THE INVENTION

Figure 1:
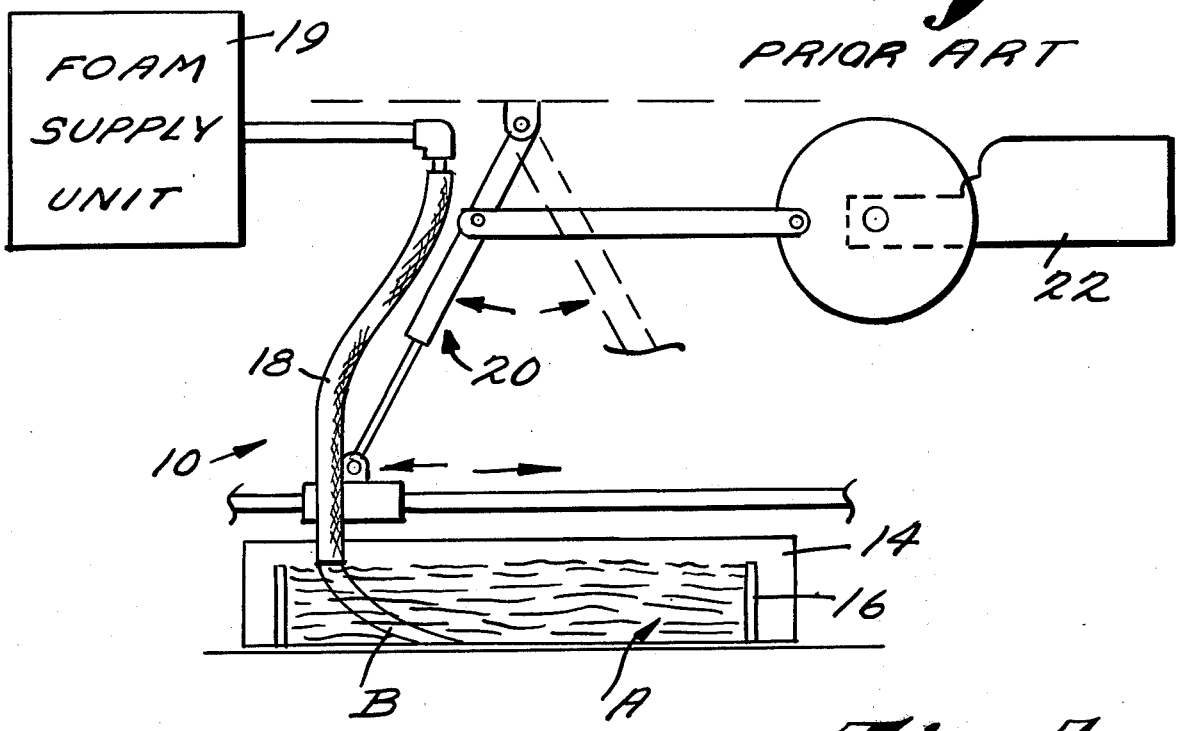
Fig. 1. PRIOR ART
FIG. 1 is a rear diagrammatic view of conventional apparatus for practicing a common prior art method of applying a foam backing to fabric.
Figure 4:
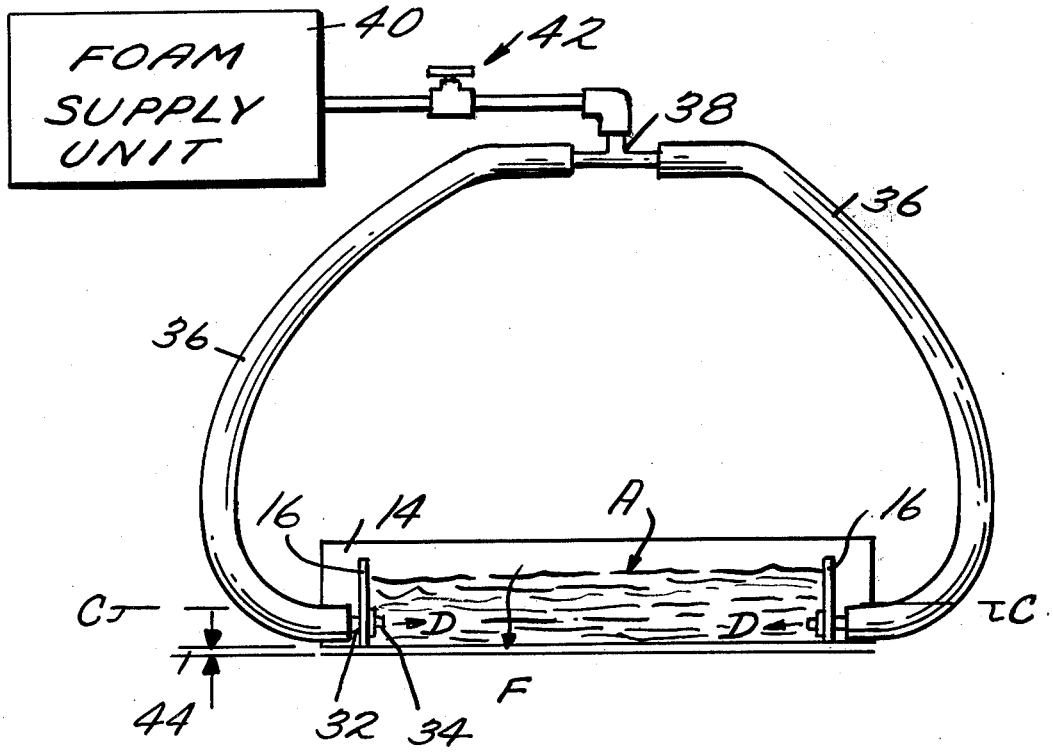
FIG. 4 is a rear diagrammatic view, similar to that of FIG. 1, showing exemplary apparatus according to the present invention.

An exemplary prior art device for applying foam backing to fabric, such as drapes and the like, is shown in FIG. 1 generally at 10. A fabric web, 12, has a foam reservoir or pillow A established thereon. The pillow A is confined on the bottom by the web 12, on the front thereof (the side thereof toward the direction of movement of the web 12) by a doctor blade 14 or the like, and on the sides thereof by guide plates 16 or the like. Foam from a foam supply unit 19 is introduced into the pillow to replenish the supply therein by a hose 18 located slightly above the surface of the pillow A. The hose 18 is traversable by means 20, including motor 22, to insure proper distribution of the foam in the pillow.

The surface of the pillow A is caused to rotate in the direction indicated by the arrow in FIG. 1 by the action of the web moving therepast, and tends to assume a generally cylindrical shape of generally ovoid cross-section. As the new foam from the hose 18 is applied to the pillow, it has a tendency to be moved directly along the rotating surface of the pillow — as shown at B in FIG. 1 — directly into contact with the web 12 to be coated. This results in visible hose marks on the foam after being applied since the properties of the new foam (i.e. density) are different from those of the old foam; a clear line of demarcation appears along the path B. Also, there is the possibility of other streak marks or discontinuities in the foam backing being introduced by air being entrained with the foam being supplied to the pillow A.

Figure 2:
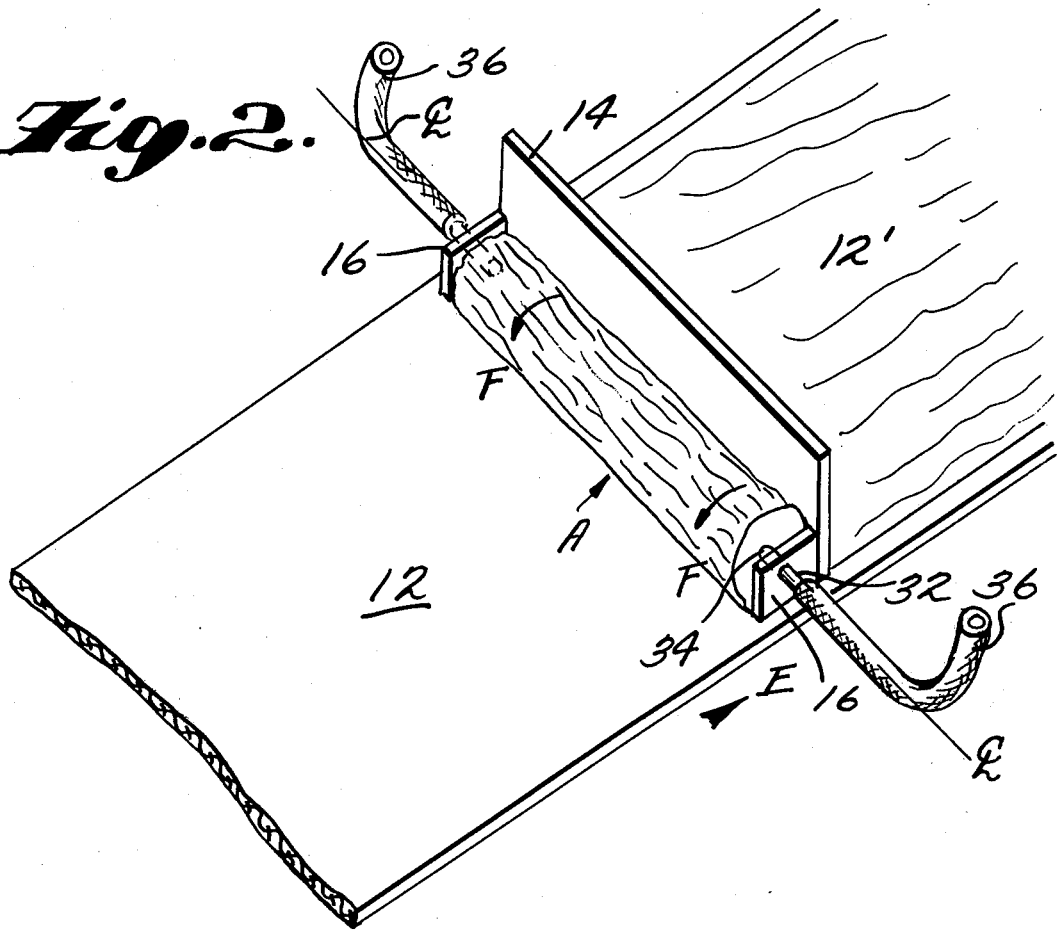
FIG. 2 is a perspective diagrammatic view, with one side wall cut away, of exemplary apparatus according to the present invention.

Exemplary apparatus according to the present invention is shown generally at 30 in the drawings. A web 12 of fabric to be backed, movable in direction E (see FIG. 2) passes past a foam pillow A confined by doctor blade 14 or the like, and side walls 16, to have a backing deposited thereon, so that a foam-backed fabric 12' is produced. However, instead of the bulky equipment shown in FIG. 1 being provided for the maintenance of the volume of foam in the pillow A, simple means are provided that do not introduce air into the pillow, and that do not cause hose marks to be formed on the finished product 12'. This apparatus preferably may comprise a pair of hoses 36 each attached at one end thereof to a nipple member 34 or the like passing through an opening 32 in a side plate 16, and attached at the other end thereof to a T-connecting conduit 38. Liquid foam is supplied from supply unit 40, through valve 42 or the like, to connection 38 for separation into the conduits 36. It is preferred that the conduits 36 are approximately the same length so that foam being supplied on either side of the pillow A through the nipples 34 will have substantially the same properties.

Figure 3:
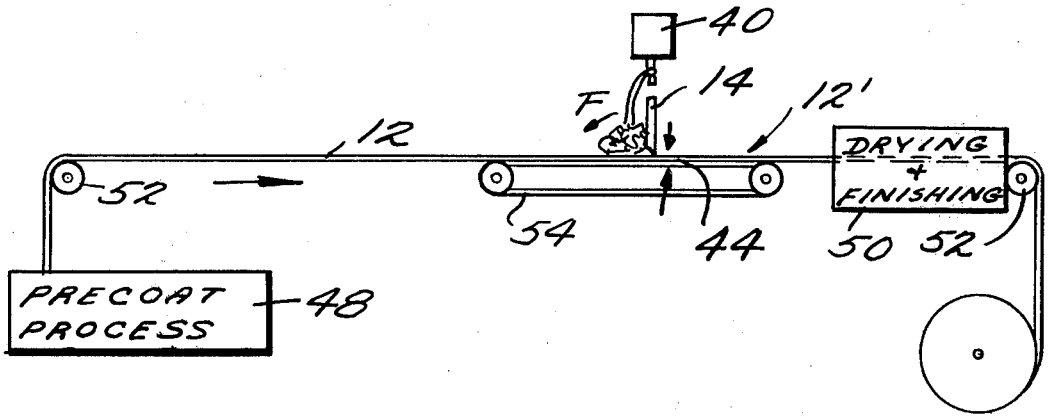
FIG. 3 is a side diagrammatic view of exemplary apparatus for practicing the method according to the present invention.

The foam in the foam pillow A rolls or rotates in the direction of arrow F as a result of the movement of the web therepast. In so rotating, the foam — which has a generally liquid consistency — assumes a generally ovoid shape, as can be seen in FIG. 3. The foam pillow A rolls or rotates substantially about an axis C—C in the direction F. New foam being introduced by the nipples 34 is introduced so that it flows generally in the direction D, which is substantially disposed along the general axis of rotation C—C of the pillow A. This means that the foam will have time to completely mix with the foam already in the pillow before moving to the surface of the pillow A to be deposited on the web 12, and no air will be entrained therewith. It is to be understood that the new foam introduced through nipples 34 need not be introduced exactly along the general axis of rotation C—C of the pillow A, but rather need just be introduced so that it is completely within the pillow A and initially flows in a generally horizontal direction D generally parallel to the plane of web 12. This is what is meant by "generally along the axis of rotation of said pillow".

As the web 12 moves in the direction E past the pillow A, it passes under the doctor blade 14 or the like, a predetermined space or gap 44 being provided between the top surface of the web 12 and the bottom surface of the blade 14. The gap 44 may be adjusted depending upon the amount of foam that is desired to be deposited on the web 12 to provide a backing therefor. As the web 12 moves under the blade 14 through gap 44, it carries with it a coating of foam from the pillow, whereby a backed sheet 12' is foamed. The doctor blade 14 or the like spaced from the web 12 thereby serves as means for allowing only a portion of the foam of said pillow A to pass with the web as it moves past the pillow.

The method and apparatus according to the present invention are especially adapted for use in foam coating drapery fabric and the like, although they are not restricted thereto. During such use, enough foam is supplied to establish the pillow A so that the long dimension of the generally ovoid shape of the pillow A is about 8–15 inches with a height of about 5–6 inches. The typical fabric width that is treated is about 44 inches, although fabrics of lesser and greater dimension can be treated as well. The nipples may be one inch in diameter, and extend from plates 16 several inches into pillow A. If the fabric width is particularly long, the nipples 34 may be elongated, and holes provided along the length thereof for introducing new foam along the length thereof, and not just at the end thereof. Although a jetting action of the foam being delivered through nipples 34 is desired in order to provide a proper distribution of the foam in the pillow A, the foam may be introduced at angles to the direction D shown in the drawings.

Suitable fabric 12 that may be coated according to the present invention include knit or woven fabrics, and non-woven fabrics. The fabric may generally be of any kind of fibers such as cotton, wool, sisal, jute, linen, and a variety of man-made fibers including, but not limited to, rayon, cellulose esters, the acrylics, polyester, etc. The foam used may be any foam suitable for fabric backing, such as the foams listed in U.S. Pat. No. 3,527,654 — for example the polymer constituting the foam may be rubber, polyurethane, polystyrene, vinyl polymers, phenolic resins, polyethylene, silicones, cellulose acetates, and others. The fabric may be precoated, such as by suitable conventional precoating means 48, and the finished backed fabric 12' may be dried or subjected to oven-treatment or otherwise finished by finishing apparatus 50. The web 12 may be moved along by rollers, and/or by engagement with a conveyor belt 54 or the like.

According to the method of the present invention, the following steps are effected:

1. A fluid-foam pillow A of a predetermined volume is established on a fabric web 12 to be backed. The initial steps in establishing the pillow are accomplished by establishing the required foam density and flow rate from the supply 40, removing the hoses 36 from the guide plates 16 and flushing the dead foam that may remain therein therefrom by operation of valve means 42 or the like, and reinserting the lines 36 into plates 16. Then the foam supply is immediately established to the back portion of doctor blade 14 or the like where the pillow A is to be formed while the cloth is not in motion. Then after a volume of foam sufficient to form a foam pillow of sufficient height (for example 5–6 inches), an operator must spread the foam evenly across the width of the web 12 — as by using a spatula — and makes sure that all dead foam has been removed. A foam pillow A is thus established, with blade 14 or the like confining the front thereof, the web 12 on the bottom thereof, and guides 16 on either side thereof.

2. After the foam pillow A is established, the web 12 is started in motion in direction E, and it passes past the pillow A, and in contact therewith, whereby foam from the pillow is deposited thereon.

3. Only a portion of the foam in the pillow A is allowed to pass with the web 12 as it moves past the pillow A — the amount of foam from the top surface of web 12 to the bottom surface of the blade 14 or the like, as determined by the adjustment of gap 44.

4. The foam in the pillow A is continuously replenished to substantially maintain the predetermined volume thereof by introducing a flow of foam into the pillow A at two spaced points (nipples 34) in the interior of the pillow A generally along the general axis of rotation C—C of the pillow A, one of the points 34 being on either side of the pillow A. This may be accomplished by introducing foam through lines 36 having nipples 34 thereof passing through openings 32 in either plate 16.

After the coated web 12' passes the blade 14, it may be subjected to various standard finishing processes, such as drying, and the web 12 may be subjected to various pretreatments before coating.

While the invention has been herein shown and described in what is presently conceived to be the most practical and preferred embodiment of the invention, it will be obvious to one of ordinary skill in the art that many modifications may be made thereof within the scope of the invention, and that the invention should be accorded the broadest scope of the appended claims so as to encompass all equivalent structures and devices.

What is claimed is:

1. Apparatus for applying a foam coating to a fabric to provide a backing therefor, comprising a. means for defining a fluid-foam pillow of a predetermined volume on a web of fabric to be backed, the volume having a top, bottom, front, back, and two sides, and said means for defining the fluid-foam pillow comprising means for confining the front and sides of the pillow, the fabric web supporting the bottom of the pillow, b. means for passing fabric of said web past said foam pillow, said pillow generally rolling about an axis which is transverse with respect to said web as said fabric web is moved with respect thereto, c. means for allowing only a portion of the foam in said pillow to pass with said web as it moves past said pillow, and d. means for continuously replenishing the foam material in said pillow to substantially maintain said predetermined volume thereof by introducing a flow of foam into said pillow at least two spaced points in the interior of said pillow, said flow being introduced generally along said transverse axis of said pillow, one of said points being on either side of said pillow.

2. Apparatus as recited in claim 1 wherein said means for defining the front comprises a doctor blade.

3. Apparatus as recited in claim 2 wherein said means for allowing only a portion of said foam to pass with said fabric as it moves past said pillow comprises means defining a predetermined gap between the bottom surface of said doctor blade and said moving web.

4. Apparatus as recited in claim 1 wherein said means for continuously replenishing said foam volume comprises a main hose extending from a foam source, a pair of hoses extending from said main hose, each of said pair of hoses in fluid communication with said main hose at one end thereof, and having an end portion at the other end thereof inserted into said foam pillow.

5. Apparatus as recited in claim 4 wherein said means for defining said pillow of predetermined volume includes a pair of side guide plates, each of said hoses of said pair having the end portion thereof formed as a nipple extending through a guide plate.

6. Apparatus as recited in claim 5 further comprising valve means interposed in said main hose extending from the foam source for selectively allowing and preventing the passage of foam therethrough.

* * * * *

UNITED STATES PATENT OFFICE

CERTIFICATE OF CORRECTION

Patent No. 4,016,831 Dated April 12, 1977

Inventor(s) Forrest T. James and Stephen L. Guy

It is certified that error appears in the above-identified patent and that said Letters Patent are hereby corrected as shown below:

Column 2, line 2, change "form" to --foam--.

Column 3, line 61, change "foamed" to --formed--.

Column 6, line 7, insert --at-- after "at".

Signed and Sealed this

*Twenty-second* Day of *January 1980*

[SEAL]

*Attest:*

SIDNEY A. DIAMOND

*Attesting Officer*

*Commissioner of Patents and Trademarks*